US011910866B2

(12) United States Patent
Schoppel et al.

(10) Patent No.: US 11,910,866 B2
(45) **Date of Patent: *Feb. 27, 2024**

(54) KNITTED LOFT ZONES

(71) Applicant: NIKE, Inc., Beaverton, OR (US)

(72) Inventors: Andreas I. Schoppel, Beaverton, OR (US); Erin C. Stevens, Portland, OR (US); Seth M. Wiberg, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 236 days.

This patent is subject to a terminal disclaimer.

(21) Appl. No.: 17/163,967

(22) Filed: Feb. 1, 2021

(65) Prior Publication Data

US 2021/0153595 A1 May 27, 2021

Related U.S. Application Data

(63) Continuation of application No. 16/163,872, filed on Oct. 18, 2018, now Pat. No. 10,945,482.
(Continued)

(51) Int. Cl.
*A43B 1/04* (2022.01)
*D04B 1/08* (2006.01)
(Continued)

(52) U.S. Cl.
CPC ..... *A43B 1/04* (2013.01); *A43B 23/028* (2013.01); *A43B 23/0245* (2013.01);
(Continued)

(58) Field of Classification Search
CPC ..... D04B 9/12; D04B 7/12
(Continued)

(56) References Cited

U.S. PATENT DOCUMENTS 2,372,497 A 3/1945 Johnson et al.
4,785,558 A 11/1988 Shiomura
(Continued)

FOREIGN PATENT DOCUMENTS

CN 101005944 A 7/2007
CN 101177831 A 5/2008
(Continued)

OTHER PUBLICATIONS

Office Action with English Translation for Chinese Patent Application No. 201880067040.4 dated Feb. 3, 2021; 14 pages.
(Continued)

*Primary Examiner* — Grace Huang
(74) *Attorney, Agent, or Firm* — SHOOK, HARDY AND BACON L.L.P.

(57) ABSTRACT

A knitted component may include a loft zone having at least one first loft portion that is integrally knit. The loft portion may include a first knitted layer, a second knitted layer having an elasticated first material, a void between the first knitted layer and the second knitted layer, and at least one course of a second material that is knitted within the void and causes the first knitted layer to extend away from the second knitted layer by a first distance of about 2-5 mm. Each loft portion has a width of about 4-10 mm between connection points between the first and second knitted layers.

15 Claims, 6 Drawing Sheets

Related U.S. Application Data

(60) Provisional application No. 62/574,989, filed on Oct. 20, 2017.

(51) Int. Cl.

| | |
|---|---|
| ***D04B 21/14*** | (2006.01) |
| ***D04B 1/22*** | (2006.01) |
| ***D04B 1/10*** | (2006.01) |
| ***D04B 1/24*** | (2006.01) |
| ***D04B 7/04*** | (2006.01) |
| ***D04B 1/18*** | (2006.01) |
| ***A43B 23/02*** | (2006.01) |

(52) U.S. Cl.
CPC ..... *D04B 1/102* (2013.01); *D04B 1/18* (2013.01); *D04B 1/22* (2013.01); *D04B 1/24* (2013.01); *D04B 7/04* (2013.01); *D04B 21/145* (2013.01); *D10B 2331/02* (2013.01); *D10B 2403/0222* (2013.01); *D10B 2403/0331* (2013.01); *D10B 2501/043* (2013.01)

(58) Field of Classification Search
USPC ..... 66/171, 196
See application file for complete search history.

(56) References Cited

U.S. PATENT DOCUMENTS

| | | | | |
|---|---|---|---|---|
| 5,731,062 | A | 3/1998 | Kim et al. | |
| 5,807,295 | A | 9/1998 | Hutcheon et al. | |
| 5,940,887 | A * | 8/1999 | Rajala | A61F 13/72 2/400 |
| 6,105,401 | A * | 8/2000 | Chadeyron | D04B 1/22 66/196 |
| 6,630,414 | B1 | 10/2003 | Matsumoto | |
| 7,076,891 | B2 | 7/2006 | Goodwin | |
| 7,174,750 | B2 * | 2/2007 | Shirasaki | D04B 21/16 66/196 |
| 7,213,421 | B2 * | 5/2007 | Shirasaki | D04B 21/14 66/196 |
| 7,235,504 | B2 | 6/2007 | Shirasaki et al. | |
| 7,552,604 | B1 | 6/2009 | Waldrop et al. | |
| 7,565,821 | B2 | 7/2009 | Park et al. | |
| 7,937,973 | B2 * | 5/2011 | Sorensen | A61F 13/04 66/196 |
| 8,839,530 | B2 | 9/2014 | Smith et al. | |
| 9,192,204 | B1 | 11/2015 | Liles et al. | |
| 9,192,208 | B2 | 11/2015 | Peikert et al. | |
| 9,668,530 | B2 | 6/2017 | Miller et al. | |
| 10,294,591 | B2 | 5/2019 | Podhajny et al. | |
| 10,544,528 | B2 | 1/2020 | Tuscia et al. | |
| 10,945,482 | B2 * | 3/2021 | Schoppel | A43B 1/04 |
| 2001/0008053 | A1 | 7/2001 | Belli | |
| 2006/0185401 | A1 | 8/2006 | Shirasaki et al. | |
| 2007/0144221 | A1 | 6/2007 | Sytz | |
| 2007/0250147 | A1 | 10/2007 | Walther et al. | |
| 2013/0139407 | A1 * | 6/2013 | Brongers | A43B 17/02 36/44 |
| 2015/0113829 | A1 * | 4/2015 | Kodad | A43B 5/00 383/105 |
| 2016/0165959 | A1 | 6/2016 | Hayes | |
| 2018/0055137 | A1 * | 3/2018 | Fraser | A43B 5/14 |
| 2019/0037966 | A1 | 2/2019 | Aceves Tinajero et al. | |
| 2019/0062963 | A1 | 2/2019 | Heiner et al. | |
| 2019/0313728 | A1 | 10/2019 | Berrian et al. | |
| 2019/0365049 | A1 | 12/2019 | Verfl | |

FOREIGN PATENT DOCUMENTS

| | | | | |
|---|---|---|---|---|
| CN | 101871153 | A | 10/2010 | |
| EP | 2 792 264 | A2 | 10/2014 | |
| EP | 3 260 005 | A1 | 12/2017 | |
| JP | 02229247 | A * | 9/1990 | D04B 21/14 |
| JP | 2003013346 | A * | 1/2003 | D04B 21/14 |
| WO | WO 2016/197051 | A1 | 12/2016 | |
| WO | 2017/075587 | A1 | 5/2017 | |
| WO | WO 2017/208273 | A1 | 12/2017 | |
| WO | WO 2018/038891 | A1 | 3/2018 | |

OTHER PUBLICATIONS

International Search Report and Written Opinion of the International Searching Authority for International Application No. PCT/US2018/056448 dated Jan. 16, 2019; 16 pages.
International Preliminary Report and Written Opinion of the International Searching Authority for International Application No. PCT/US2018/056448 dated Apr. 21, 2020; 9 pages.
Office Action received for European Patent Application No. 18801092.0, dated Jul. 14, 2022, 9 pages.
Final Office Action received for U.S. Appl. No. 16/163,872, dated May 28, 2020, 33 pages.
Non-Final Office Action received for U.S. Appl. No. 16/163,872, dated Feb. 4, 2020, 30 pages.
Non-Final Office Action received for U.S. Appl. No. 16/163,872, dated Sep. 29, 2020, 33 pages.
Notice of Allowance received for U.S. Appl. No. 16/163,872, dated Jan. 11, 2021, 7 pages.

* cited by examiner

KNITTED LOFT ZONES

CROSS-REFERENCE TO RELATED APPLICATIONS

This application is a continuation of U.S. Non-provisional patent application Ser. No. 16/163,872, filed on Oct. 18, 2018, pending, which application claims the benefit of U.S. Provisional Patent Application No. 62/574,989, filed on Oct. 20, 2017, the entireties of which are hereby incorporated by reference.

BACKGROUND

The present embodiments relate generally to knitted components and methods of manufacturing knitted components, for example, knitted components for use in apparel and footwear applications.

SUMMARY

According to an embodiment, a knitted component may include a loft zone having at least one first loft portion that is integrally knit. The loft portion may include a first knitted layer having an elasticated first material, a second knitted layer, a void between the first knitted layer and the second knitted layer, and at least one course of a second material that is knitted within the void and causes the second knitted layer to extend away from the first knitted layer by a first distance. The at least one course of the second material may include at least one float and may project into the void. The second material may have a greater resistance to bending than the elasticated first material. The at least one first loft portion may include a connection point between the first knitted layer and the second knitted layer. The elasticated first material may have a maximum elongation greater than a certain threshold, for example 200%. The second material may be a monofilament strand. The at least one float of the at least one course of the second material may have a float length greater than or equal to a certain threshold, for example three needles. The loft zone may include a plurality of apertures. The knitted component may include a second loft zone having an elasticated third material with a different elasticity than the elasticated first material. The at least one first loft portion may have a course-wise orientation.

According to some embodiments, an article of footwear may include a knitted component defining at least part of a void. The knitted component may include an interior layer having an elasticated first material knitted, and an exterior layer. A first loft zone may be knitted into the knitted component and may have at least one first loft portion extending away from the void, the at least one first loft portion having a space formed between freely separable areas of the interior and exterior layers and at least one course of a second material knitted within the space. The at least one course of the second material may project into the space, causing the exterior layer to extend away from the interior layer. The at least one first loft portion may have a first width and may extend away from the void by a first distance. The at least one first loft portion may include a plurality of first loft portions forming a pattern in the exterior layer. The first loft zone may extend from a medial side of the knitted component to a lateral side of the knitted component in a midfoot region. The first loft zone may include apertures extending through the exterior layer and forming part of a closure system. A second loft zone may be knitted into the knitted component and may include at least one second loft portion having a second width and extending away from the void by a second distance, and the second width may differ from the first width. The second loft zone may be located in a throat portion of the knitted component.

According to some embodiments, a method of knitting a component may include knitting a pocket between overlapping and integrally knit areas of an elasticated first layer and a second layer, and knitting at least one course of a material within the pocket such that the material projects into the pocket and causes the second layer to extend away from the first layer. The step of knitting the pocket may include knitting at least one connection point between the elasticated first layer and the second layer. The step of knitting the pocket may include knitting the elasticated first layer under tension. The step of knitting the at least one course of the material may include knitting at least one float. The step of knitting the at least one course of the material may include knitting at least one float having a first float length and a second float having a second float length. The step of knitting the at least one course of the material may include knitting the at least one course of the material into the elasticated first layer and the second layer. The step of knitting the pocket may include causing the elasticated first layer to pull against the second layer via the at least one connection point.

Other systems, methods, features and advantages will be, or will become, apparent to one with skill in the art upon examination of the following figures and detailed description. It is intended that all such additional systems, methods, features and advantages be within the scope of the disclosure, and be encompassed by the following claims.

BRIEF DESCRIPTION OF THE DRAWINGS

The described features can be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

DETAILED DESCRIPTION OF THE PREFERRED EMBODIMENTS

Figure 1:
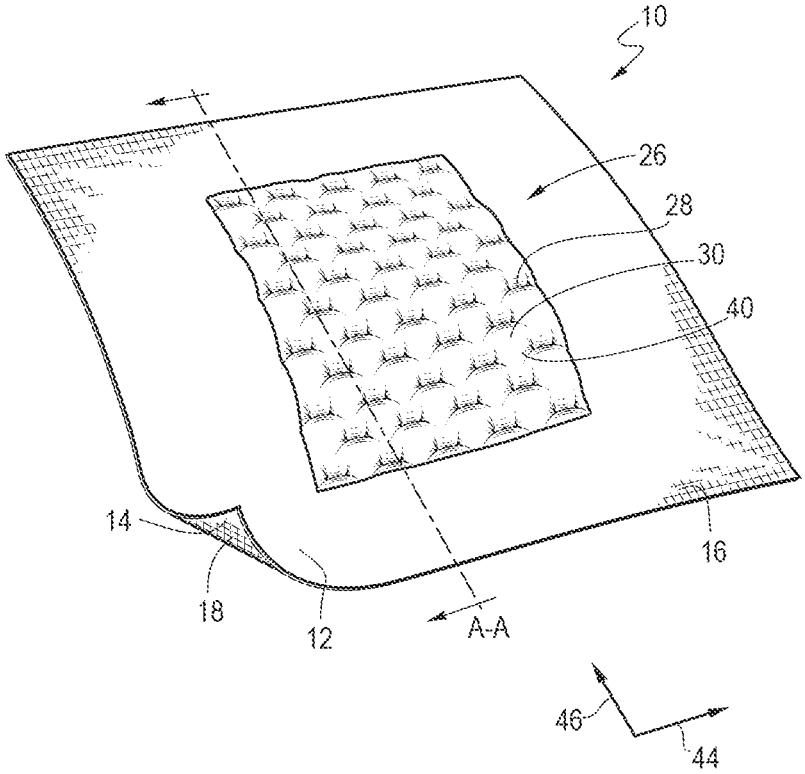
FIG. 1 shows a knitted component including a loft zone.
Figure 2:
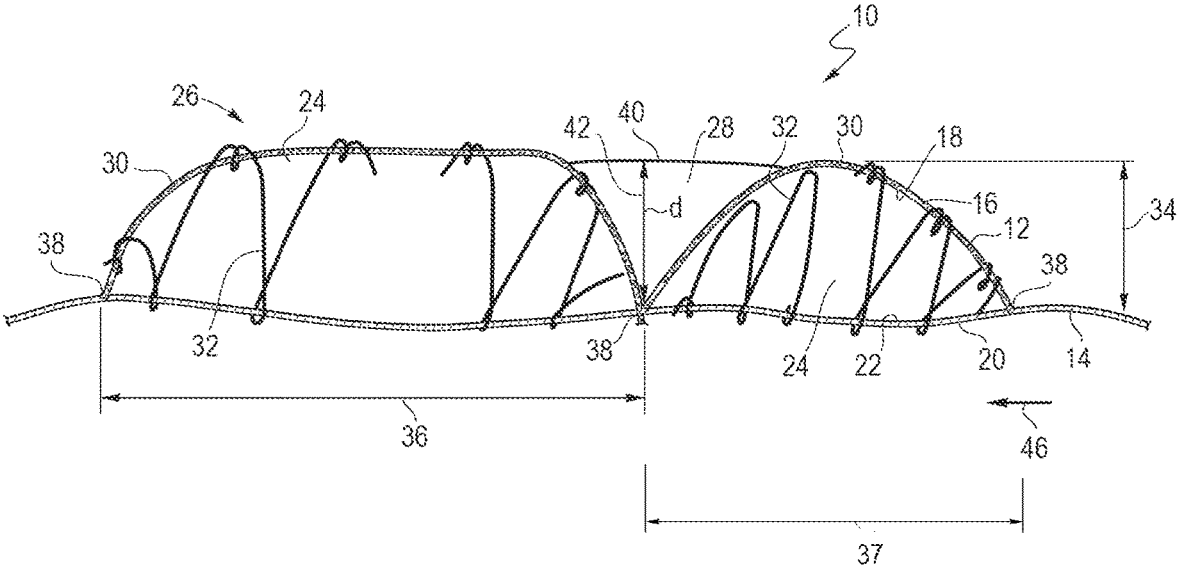
FIG. 2 shows a section view of the knitted component of FIG. 1 illustrating exemplary loft portions.

FIGS. 1 and 2 (taken along section line A-A) illustrate a knitted component 10 that may be utilized in a number of applications, for example as part of a garment or as part of an upper of an article of footwear. Knitted component 10 may be made of at least a first layer 12 and a second layer 14, which may be integrally knit (i.e., substantially formed in the same knitting process) and may overlap and be freely separable in certain areas. The first layer 12 may have an exterior surface 16 and an opposite-facing interior surface 18 in areas where the first layer 12 is freely separable from the second layer 14. Like the first layer 12, the second layer 14 may have an exterior surface 20 and an opposite-facing interior surface 22 in areas where the first layer 12 is freely separable from the second layer 14. In areas where the first layer 12 overlaps and is freely separable from the second layer 14, the overlapping portions of the first layer 12 and the second layer 14 may form a void 24, a space, a pocket, or other opening in between. The first layer 12 may overlap and be freely separable from additional layers in other locations of the knitted component 10. For example, the first layer 12 may overlap and be freely separable from a third layer (not shown) in an area of the knitted component 10 where the first layer 12 also overlaps the second layer 14; in other words, several layers may overlap. Additionally or alternatively, the first layer 12 may overlap and be freely separable from the third layer in an area where the first layer 12 does not overlap the second layer 14; in other words, the second layer 14 and the third layer may exist in different location of the knitted component 10. In either case, the second and third layers may have different properties, e.g., different elasticities and knit structures.

Knitted component 10 includes an integrally-knitted loft zone 26, which may generally correspond with an area having a lofted, loft-like, or high-volume appearance, i.e., the visual effect of loft, but not necessarily with the bulk and expense of yarns having high loft or bulk. The loft zone 26 is integrally knitted as part of the knitted component 10 substantially during a single knitting process, without the need for substantial post-processing steps. As used in this application, the term "loft" may refer to a physical property, aesthetic quality, and/or other characteristic of a knitted component, for example a knit structure of a knitted component. Loft may be a product of one or more of the knit structure and material properties. For example, it is contemplated that the knit structure may contribute to the loft of loft zone 26 even if properties of materials utilized in the knit structure (e.g., density) may not significantly contribute to loft. It is contemplated that material properties may also contribute to the loft of loft zone 26, independently from the knit structure. To clarify, it is contemplated that areas of knitted components disclosed in this application (e.g., loft zones) may have loft or be loft-like due significantly to the knit structure, and may not necessarily contain bulky or high-density materials. In some cases, loft may be quantified by physical dimensions, e.g., a distance between a first and a second layer, a thickness, a depth of a recess, a volume of a void or space, and a width of a portion of the loft zone (e.g., between connection points). For example, loft may refer to the thickness of an area of the knitted component 10, whether in an absolute sense and/or relative to other areas of the knitted component 10. As another example, loft may increase as the distance between the first layer 12 and the second layer 14 increases. As another example, loft may increase as the volume of the void 24 between the first layer 12 and the second layer 14 increases. As another example, loft may increase as the depth of a recess formed relative to the exterior surface 16 increases. In other words, as used in this application, the loft, loft-like appearance, or other loft-related property may be indicated with reference to any of the foregoing measures. Loft zones of knitted components described in this application, in particular a surface of a knitted layer, may appear pillow-like, quilt-like, or cloud-like to a viewer; it shall be understood that those portions may have loft or be loft-like, regardless of whether those areas contain yarns, strands, filaments, or other materials having high loft, e.g., bulking yarns.

In the knitted component 10 of FIGS. 1-2, the loft zone 26 may be knitted into the knitted component 10 at a location selected to provide targeted cushioning, soft feel, visual effect, insulation, or for other advantage. The loft zone 26 (or a plurality of loft zones) may extend substantially throughout the knitted component 10, or may cover less than the entire knitted component 10. The loft zone 26 may not have discrete borders, but may gradually transition into other parts of the knitted component 10, e.g., another loft zone. The loft zone 26 may share basic knit structures with other loft zones (not shown), yet may vary in certain aspects, for example to create different amounts of loft and/or other visual appearance. In certain applications, the loft zone 26 may interact with elements of a larger system, for example a closure system in a garment or an article of footwear.

The knit structures of the loft zone 26 may include one or more of the voids 24, pockets, spaces, channels, passageways, or other voluminous areas formed between freely separable areas of the first layer 12 and the second layer 14. There may be one or more recesses 28 that are depressed relative to the exterior surface 16 of the first layer 12, thereby giving the exterior surface 16 an undulating profile, for example a cloud-like, pillow-like, quilt-like, or similar profile. Due to one or more recesses 28 or other features of the loft zone 26, the exterior surface 16 may have an irregular structure or a pattern-like structure. The underlying knit structures of the loft zone 26 may cause the exterior surface 16 to convey a pattern-like, lattice-like, mosaic-like, or similar appearance; however, the underlying knit structures need not form uniform shapes, nor does the exterior surface 16 need to form a pattern or have a uniform or symmetrical appearance.

The loft zone 26 may include one or more loft portions 30, each of which may include similar knit structures to create volume and loft. Each loft portion 30 may include a portion of the first layer 12 that extends away from an underlying portion of the second layer 14, and a material 32 knitted in between the first layer 12 and the second layer 14. For each loft portion 30, the first layer 12 may extend away from the second layer 14 by a distance 34. For example, a loft portion 30 in a loft zone 26 may include a portion of the first layer 12 that extends away from the second layer 14 by a distance 34 of about 2-3 mm, about 3-4 mm, about 4-5 mm, or a greater distance 34. Each loft portion 30 may also have a width, for example, widths 36, 37, between a connection point 38 between the first layer 12 and the second layer 14 and another reference point (e.g., another connection point). For example, a loft portion 30 may have a width 36, 37 of about 4-6 mm, about 6-8 mm, about 8-10 mm, or a greater width. Adjacent loft portions 30 may transition into each other at optional transition portions 40, where the first layer 12 and the second layer 14 may remain freely separable and the exterior surface 16 comprising the transition portions 40 appears to "connect" adjacent loft portions 30. Although loft portions 30 may not have precise boundaries, in some embodiments adjacent loft portions 30 may be distinguished by one or more recesses 28 that are depressed relative to the exterior surface 16 of the first layer 12, with each recess 28 having a depth 42. The depth 42 of each recess 28 may correspond approximately with the distance 34 by which the first layer 12 extends away from the second layer 14. For example, adjacent loft portions 30 may be separated by a recess 28 having a depth 42 of about 2-3 mm, about 3-4 mm, about 4-5 mm, or greater depth. With respect to each loft portion 30, the extending away portion of the first layer 12 may have an elongate shape that extends in a first direction 44 (e.g., along a course-wise direction) and is demarcated in a second direction 46 (e.g., a wale-wise direction) by recesses 28 and transition portions 40.

In embodiments including transition portions 40 between loft portions 30, the loft portions 30 may appear as a lattice or other continuous arrangement. In other embodiments, loft portions 30 may have one or more different discrete shapes. For example, a loft portion 30 may have an approximately geometric shape such as a circle, a triangle, a square, a rectangle, a rhombus, a pentagon, a hexagon, a curve (e.g., a sinusoid or other curve extending in the first direction 44), etc. In other embodiments, loft portions 30 may have non-geometric shapes, such as organic and/or irregular shapes. In FIG. 1, each loft portion 30 has an approximately course-wise orientation (corresponding to the first direction 44), but in other embodiments, loft portions 30 need not have such an orientation. For example, loft portions 30 may have an approximately wale-wise orientation, other orientation that is neither wale-wise nor course-wise, or no orientation at all (for example, in embodiments where each loft portion has a different shape from other loft portions).

Referring to FIG. 2, areas of each of the first layer 12 and the second layer 14 are freely separable between connection points 38. In FIG. 2, the connection points 38 are interlayer knit stitches, i.e., where a stitch of the first layer 12 interloops with a stitch of the second layer 14 as a result of the knitting process. Such interlooping may occur at an interface between the interior surfaces 18, 22 of the first layer 12 and the second layer 14, respectively. A plurality of interlayer knit stitches may form an interlayer knit stitch line, which may be linear or have any other shape. Or, a plurality of interlayer knit stitches may not form a line, but may form a non-linear arrangement (e.g., a pattern over an area). A plurality of interlayer knit stitches may extend in a course-wise or a wale-wise direction. The connection points 38 may correspond with one or more recesses 28 that are depressed relative to the exterior surface 16 of the first layer 12. The first layer 12 and the second layer 14 have opposite facing surfaces in voids 24 between connection points 38. In some embodiments, the voids 24 (which may resemble a pocket, channel, passageway, or other voluminous area) may interconnect elsewhere within the knitted component 10, forming a continuous network of space between freely separable portions of the first layer 12 and the second layer 14. Alternatively, the voids 24 may not interconnect, but rather may be discrete. The voids 24 of the present application may differ from other knit structures, for example ottomans and welts, which may be formed by knitting an initial course on both a first and second needle bed to tie those needle beds together, then building a plurality of courses of a material on one needle bed, and then knitting another course to tie the first and second needle beds together again (e.g., at the location of the initial course) in order to knit a hollow tube-like knit structure. For example, the voids 24 of FIG. 2 may be formed in the first direction 44 (into the page of FIG. 2, which may correspond to a course-wise direction) or the second direction 46 (which may correspond to a wale-wise direction), depending upon the location and orientation of connection points 38 and transition portions 40.

Referring still to FIGS. 1-2, the first layer 12 may be knitted from one or more materials, for example to provide durability, abrasion resistance, and/or a soft hand touch. The first layer 12 may have single-bed or multi-bed knit construction. For example, at least a portion of the first layer 12 may have single-jersey knit construction to impart a degree of mechanical stretch and resiliency. A wide range of materials may be suitable for the first layer 12, for example polyester yarns having relatively low elasticity (e.g., as measured by Young's modulus or percent elongation before breaking) and relatively high durability (e.g., as measured by tensile strength or tenacity). Other yarn types are possible, including nylon yarns (which may also offer relatively high durability).

The second layer 14 may be knitted from one or more materials, including materials having elastic properties, including elasticated yarns. Suitable elasticated yarns may incorporate elastane fiber(s), such as those available from E.I. duPont de Nemours Company under the LYCRA trademark. Such yarns may have the configuration of covered LYCRA, for example yarns having a LYCRA core that is surrounded by a nylon sheath. Other fibers or filaments exhibiting elastic properties may also be utilized, for example elasticated polyester yarns. The degree of elasticity of the second layer 14 may positively correlate with the amount of loft exhibited by the loft portion 30 and the loft zone 26. For example, a loft portion 30 having a second layer 14 knitted with a yarn having relatively high elasticity (e.g., a yarn having a maximum elongation before breaking of at least 150%) may exhibit greater loft or a more pronounced loft-like appearance than a loft portion 30 having a second layer 14 knitted with a yarn having lower elasticity (e.g., a yarn having a maximum elongation of approximately 20-50%), all else equal. However, both yarn types may be appropriate to form part of a loft portion 30, as suitable elasticated materials for the second layer 14 may have a maximum elongation of approximately 20% to approximately 300%. In one embodiment, a first loft zone may include a material with a maximum elongation of approximately 215% (plus or minus 35%), and a second loft zone exhibiting less loft may include a material having maximum elongation of approximately 35% (plus or minus 10%). The exact elasticity of a particular elasticized material may vary between samples, yet the material may nevertheless be suitable for the second layer 14. For example, a particular elasticized material may have a minimum and maximum acceptable elasticity of 25% and 45%, respectively, or 180% and 250%, respectively. For example, suitable materials for the second layer 14 may have a maximum elongation that ranges between approximately 20-40%, 25-45%, or 180-250%.

Referring still to FIGS. 1 and 2, when the second layer 14 is knitted with an elasticated material as described above, it may experience a tensile force in one or both of the first and second directions 44, 46, which may result from the knitting process and/or the knit structure. In either case, the tension force experienced by the elasticated material may cause the second layer 14 to contract toward an unstretched equilibrium state. For example, the elasticated material of the second layer 14 may be knit under tension. This tension may be intentionally adjusted as part of the knitting process. Additionally or alternatively, the second layer 14 may experience a tensile force due to its knit structure (e.g., interlooped wales of the second layer 14 resisting stretch), due to differences in the knit structure between the first layer 12 and the second layer 14, or other characteristics of the knit structure. As one example, the second layer 14 may have a single jersey knit construction with a relatively high degree of stretch in both the wale-wise and course-wise directions. In such cases, a wale-wise or course-wise force applied to the second layer 14 would create a tensile force within the second layer 14. As another example, one or more connection points 38 may connect the second layer 14 to the first layer 12 such that the second layer 14 is stretched.

Due in part to the tension force, the second layer 14 may contract toward its equilibrium state. This contraction may pull on the first layer 12 via the one or more connection points 38, causing those locations of the first layer 12 to contract also. As the first layer 12 contracts at the one or more connection points 38, an area of the first layer 12 (e.g., the area in between two connection points 38) may tend to form a convex shape (such as a bubble shape), especially when another material occupies at least part of the void 24 in between the first layer 12 and the second layer 14, such as a material knitted within the pocket (e.g., a material that contributes to the loft of the knit structure, described below). This tendency of the first layer 12 to form a convex shape may occur in one or both of the first and second directions 44, 46. For example, in the embodiment of FIG. 2, the second layer 14 may contract at least in the second direction 46 (which may correspond to the wale-wise direction), causing the first layer to form a convex shape. Thus, by forming the knitted component 10 so that the second layer 14 contracts and the first layer 12 tends to form a convex shape, the void 24 between freely separable areas of the first layer 12 and the second layer 14 may achieve greater volume, thus contributing to the lofted appearance of the loft zone 26.

As noted above, the knitted component 10 may achieve greater loft through the use of a material 32 knitted into the voids 24 in order to impart additional loft and/or volume to the loft zone 26 and one or more loft portions 30. In particular, the material 32 may be knitted into one or both of the first layer 12 and the second layer 14 such that a portion of the material 32 occupies the void 24 yet remains integrally knit with the knitted component. For example, one or more courses of the material 32 may project into the void 24, causing the first layer 12 to extend away from the second layer 14. Further, although the material 32 may substantially occupy the voids 24, additional materials may also occupy the voids. This construction differs from other knitted components, which may include voids but do not include integrally knit material within the voids (e.g., a void stuffed with a filler or bulking material).

Suitable materials for the material 32 may have relatively high resistance to bending, which may be quantified by material properties such as bending modulus (flexural modulus), flexural rigidity, and other properties. The resistance to bending of material 32 may additionally or alternatively be characterized by reference to other materials that form the knitted component 10. For example, material 32 may have greater resistance to bending than one or more materials forming the first layer 12 and/or the second layer 14, such as an elasticated material that forms at least part of the second layer 14. There may be a positive correlation between the resistance to bending of material 32 and the loft exhibited by the loft zone 26 of the knitted component 10, in particular the loft portions 30. For example, a material 32 with relatively high resistance to bending, e.g., a nylon monofilament strand, may project into the void 24 and push the first layer 12 away from the second layer 14 with greater force than a polyester multifilament yarn of the same diameter. While it is desirable for the material 32 to have a relatively high resistance to bending, the bending resistance may be low enough to allow the material 32 to bend into knit loops, tucks, and other configurations produced by the knitting process. Further, it may also be desirable for the material 32 to resist kinking when bent, especially when bent into shapes formed by knitting processes. In addition, suitable materials 32 may also have relatively low density in order to save weight. In applications where bulk and/or insulation are desirable, suitable materials 32 may alone have a relatively high degree of loft (as compared to the loft of the knit structure or the knit component). However, it is also contemplated that suitable materials 32 need not have a relatively high degree of loft, for example in applications where bulk and/or insulation are undesirable. Suitable materials 32 may include monofilament strands, such as nylon monofilament strands, which while difficult to knit on a knitting machine, offer exceptional resistance to bending and kinking, and have relatively low density. As one non-limiting example, nylon monofilament strands having a diameter ranging from approximately 0.05 mm to approximately 0.3 mm may be suitable, for example a nylon monofilament strand having a 0.125 mm diameter. Other suitable materials 32 may be appropriate.

The material 32 may be knitted in such a way that it tends to substantially occupy the void 24 between the first and second layers 12, 14, e.g., by forming loops that project into the void 24 and/or by spanning the void in between stitches of the material 32 that are interlooped with the first layer 12 and/or the second layer 14. To achieve this, the material 32 may be knitted into the first layer 12 and/or the second layer 14 in such a way that its material properties cause it to resist the knit structure, for example by recoiling away from a flat or planar shape so that it projects into the void 24. When the material 32 is knitted into one of the first layer 12 or the second layer 14, it may form a tortuous, bending, twisted, circuitous, or similar shape between stitches, which may project into the void 24 and occupy a relatively large volume as compared to the displacement of the material 32. However, the material 32 may cause the first layer 12 to extend away from the second layer 14, creating loft, even if it does not assume a bending or circuitous shape within the void 24. To cause the material 32 to project into the void 24, one or more courses may have a single-bed or multi-bed knit structure that includes floats, i.e., lengths of the material between knit loops or tucks that are floated over one or more intervening needles. The float length may be characterized by the number of needles floated. In knitted components disclosed in this application, the float length may range from one needle to numerous needles, e.g., two needles, three needles, five needles, seven needles, nine needles, or a greater number of floated needles. There may be a positive correlation between the float length in a course of the material 32 and its tendency to project into the void 24. That is, the longer the float length, the greater the volume a course of the material 32 may occupy, all else equal and not considering other constraints imposed by the knitted component 10. A single course of material 32 may include floats having more than one float length. For example, a course of the material 32 may include a first portion having a first float length and a second portion having a second float length. In such a case, the first and second float lengths may correspond to different locations of the knitted component 10, for example two different loft zones 26 with two different degrees of loft.

Additionally, there may also be a positive correlation between the number of courses of the material 32 knitted within the void, and the volume or loft of the loft zone 26. However, beyond a certain number of courses of the material 32, additional courses may inhibit the ability of the material 32 to project into the void. As one example, in a knitting sequence where courses of the first layer, the second layer, and the material 32 are integrally knit as part of a single knitted component, anywhere from one course to approximately ten courses (e.g., four courses) of the material 32 may be knitted between consecutive courses of the first layer 12 and the second layer 14. Rather than knitting a large number of courses of the material 32, which may create excess weight and cost, a relatively low number of courses of the material 32 may be utilized within each void 24 and may still substantially occupy the void 24. To clarify, one void 24 corresponding to one loft portion 30 may include a relatively low number of courses of the material 32, even if the loft zone 26 contains a greater number. As a result, the knitting process itself may form the void 24 and may also form the course(s) of the material 32 that project into the void 24, creating additional loft. This structure may advantageously eliminate costly post-knitting steps.

Thus, knitted components 10 disclosed in this application may include one or more loft zones 26, each of which may include one or more loft portions 30. The amount of loft exhibited by loft zones 26 disclosed may be function of numerous variables, including the elasticity of the material(s) knitted into the second layer 14, the knit structure of the first layer 12 and the second layer 14, the location of connection points 38 between the first layer 12 and the second layer 14, the resistance to bending of the material 32, the float length(s) in courses of the material 32, and the number of courses of the material 32. Knitted components 10 having loft zones 26 may be adapted to numerous different applications, including apparel and footwear. Additionally, knitted components 10 may incorporate one or more additional structural features in conjunction the one or more loft areas, including wedges or gores, which may facilitate different knitting directions between areas.

Figure 3:
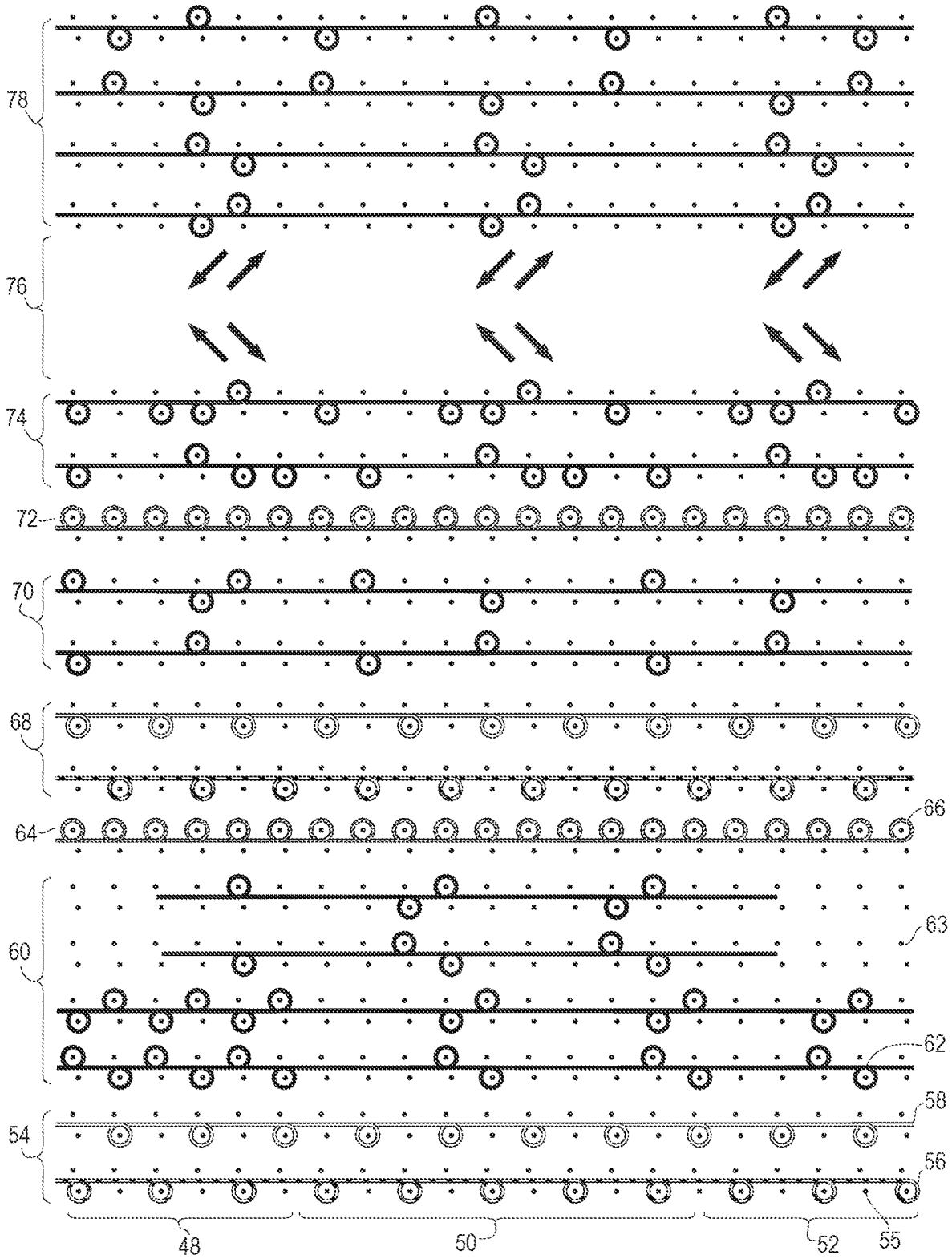
FIG. 3 shows a knit diagram corresponding to a knitted component including a loft zone.

FIG. 3 illustrates a knit diagram representing a knitting sequence that may be utilized to form a knitted component as described above, such as through a weft knitting process (e.g., with a flat knitting machine with one, two, or more needle beds, or with a circular knitting machine). The process may form the knitted component as an integral knitted component, i.e., without the need for significant post-knitting processes or steps. The knit diagram of FIG. 3 has a first zone 48, a second zone 50, and a third zone 52 along the course-wise direction, with each zone corresponding to a different loft zone of a knitted component, and further with each loft zone having different amounts of loft. At a first step 54, one or more courses of a first material 56 and a second material 58 are knitted on a first needle bed 55. In the non-limiting example of FIG. 3, the first material 56 and the second material 58 may form part of a first layer, although in other embodiments the first layer may include a greater or fewer number of materials. In this case, courses of the first and second materials 56, 58 have single-bed, less-than full gauge construction to impart a degree of stretch and resiliency to the first layer, for greater loft. At a second step 60, a plurality of courses of a third material 62 are knitted on the first needle bed 55 and a second needle bed 63. In other words, the courses of the third material 62 have multi-bed construction, although it is possible in other embodiments for courses of the third material 62 to have single-bed construction (e.g., as illustrated in FIG. 2). Further, courses of the third material 62 may interloop with one or more courses of the first and/or second materials 56, 58. As discussed above with respect to material 32, the third material 62 may be selected to have a relatively high bending resistance in order to resist the knit structure and to project into a void between the first and second layers, thereby pushing those layers apart. Courses of the third material 62 may include floats between knit stitches. In the first zone 48, courses of the third material 62 formed during second step 60 do not have floats. By comparison, in the second zone 50, courses of the third material 62 formed during second step 60 have four-needle float lengths. By further comparison, in the third zone 52, courses of the third material 62 formed during second step 60 have three-needle float lengths. As described above, there may be a positive correlation between float length and the amount of loft exhibited by the knitted component. Thus, the longer float lengths in courses of the third material 62 formed during the second step 60 in the second zone 50 may contribute to greater loft in that zone than in the first and third zones 48, 52. Additionally, the second zone 50 includes additional (and optional) partial courses of third material 62 in order to create additional loft. Next, at third step 64, one or more courses of a fourth material 66 are knitted on the second needle bed 63. The fourth material 66 may form part of a second layer of the knitted component. As discussed above, the second layer may be knitted with elasticized materials and/or knit structures selected to impart a degree of stretch to the second layer. In the example of FIG. 3, one course of the fourth material 66 has less-than full gauge, single jersey construction to impart a degree of stretch to the second layer. Because the first layer is knitted on the first needle bed 55 and the second layer is knitted on the second needle bed 63, the first and second layers overlap and are freely separable in those locations, forming a void that courses of the third material 62 occupy. At locations not shown in FIG. 3, courses of the first, second, and fourth materials 56, 58, 66 may be joined at connection points, rendering the first and second layers inseparable at those locations and potentially closing a void previously. For example, at a previous knitting step not shown in FIG. 3, one course of the first material 56 may interloop with one course of the fourth material 66 (e.g., by extending from the first needle bed 55 to the second needle bed 63), thereby creating an interlayer knit stitch and a connection point between the first and second layers. Subsequently, first, second, and third knitting steps 54, 60, and 64 may be executed to form a void between a first and second layer and to knit courses of the third material 62 into the void. Following the third step 64, steps 54, 60, 64 may be repeated to continue adding knitting height into the loft zones.

Steps 68-72 illustrate an alternative sequence for knitting part of a loft zone, which differs from steps 54-64 in that the third material 62 includes fewer courses and longer float lengths. For example, in step 68, courses of the first and second materials 56, 58 are knit in a similar manner as in first step 54. However, in alternative second step 70, the knitting process includes only two courses of the third material 62, as compared to four courses in second step 60. Taken alone, this difference may contribute to a loft zone with less loft than loft zones knitted in steps 54-64. However, courses of the third material 62 knitted in alternative second step 70 include six-needle float lengths throughout the first, second, and third zones 48, 50, 52. Taken alone, this difference may contribute to a loft zone with greater loft than loft zones knitted in steps 54-64. Whether the differences between second step 60 and alternative second step 70 create additional or less loft in the knitted loft zone may depend upon the properties of the third material 62, especially resistance to bending. Additionally, because the float length is consistent across the first, second, and third zones 48, 50, 52, the loft zone knitted according to steps 68-72 would have uniform loft across those three zones. Following alternative second step 70, step 72 may be executed to knit courses of the fourth material 66 (which may form the second layer) on the second needle bed 63, as in step 64. Following step 72, steps 68, 70, 72 may be repeated to continue adding knitting height into the loft zones.

Steps 74-78 illustrate one non-limiting sequence for knitting part of a loft zone having a plurality of apertures extending through the first layer. At step 74, courses of the first and second materials 56, 58 are knit on the first and second needle beds 55, 63 in preparation for subsequent transfer steps. At transfer step 76, the knitting machine executes a series of transfers in order to form aperture through in courses of the first and second materials 56, 58 (which may form the first layer). For example, step 76 may transfer stitches of the first material and/or second materials 56, 58 from the first needle bed 55 to adjacent needles on the second needle bed 63 and from the second needle bed 63 to adjacent needles on the first needle bed 55. The transfers executed at step 76 form apertures in the first layer by pulling the stitches away from each other. Subsequently, at step 78, the knitting machine may knit one or more courses of the third material 62 on the first and second needle beds 55, 63, such that the third material 62 is knitted into the first layer and second layer. In alternative methods, the third material 62 may be knitted into one or the other of the first and second layers, rather than both. This structure is illustrated in FIG. 2. Subsequently, the knitting machine may knit one or more courses of the fourth material 66 on the second needle bed 63 in a similar manner to steps 64 and 72.

Knitted components having loft zones as described above may be adapted to numerous applications, including apparel and footwear. Footwear applications may include knitted components that may be utilized as part of an upper and/or an article of footwear. For reference purposes, such a knitted component, upper, or article of footwear may be divided generally along a longitudinal direction (heel-to-toe) into three general regions: a forefoot region, a midfoot region, and a rearfoot region. The forefoot region may generally include portions of the knitted component, upper, or article corresponding with the toes and the joints connecting the metatarsals with the phalanges. The midfoot region may generally include portions corresponding with an arch area of the foot. The rearfoot region may generally correspond with rear portions of the foot, including areas that cover the calcaneus bone (which comprises a portion of a wearer's heel). Additionally, rearfoot region may cover some or all of the wearer's malleoli and talus (which comprise a portion of the ankle). Knitted components, uppers, and articles of footwear may also include a medial side and a lateral side, which may extend through each of forefoot region, midfoot region, and rearfoot region, and may correspond with opposite sides. More particularly, lateral side may correspond with an outside area of the foot (i.e., the surface that faces away from the other foot), and medial side may correspond with an inside area of the foot (i.e., the surface that faces toward the other foot). Forefoot region, midfoot region, rearfoot region, medial side, and lateral side are not intended to demarcate precise areas of a knitted component, upper, or article, but rather are intended to represent general areas to aid in the following discussion.

Figure 4:
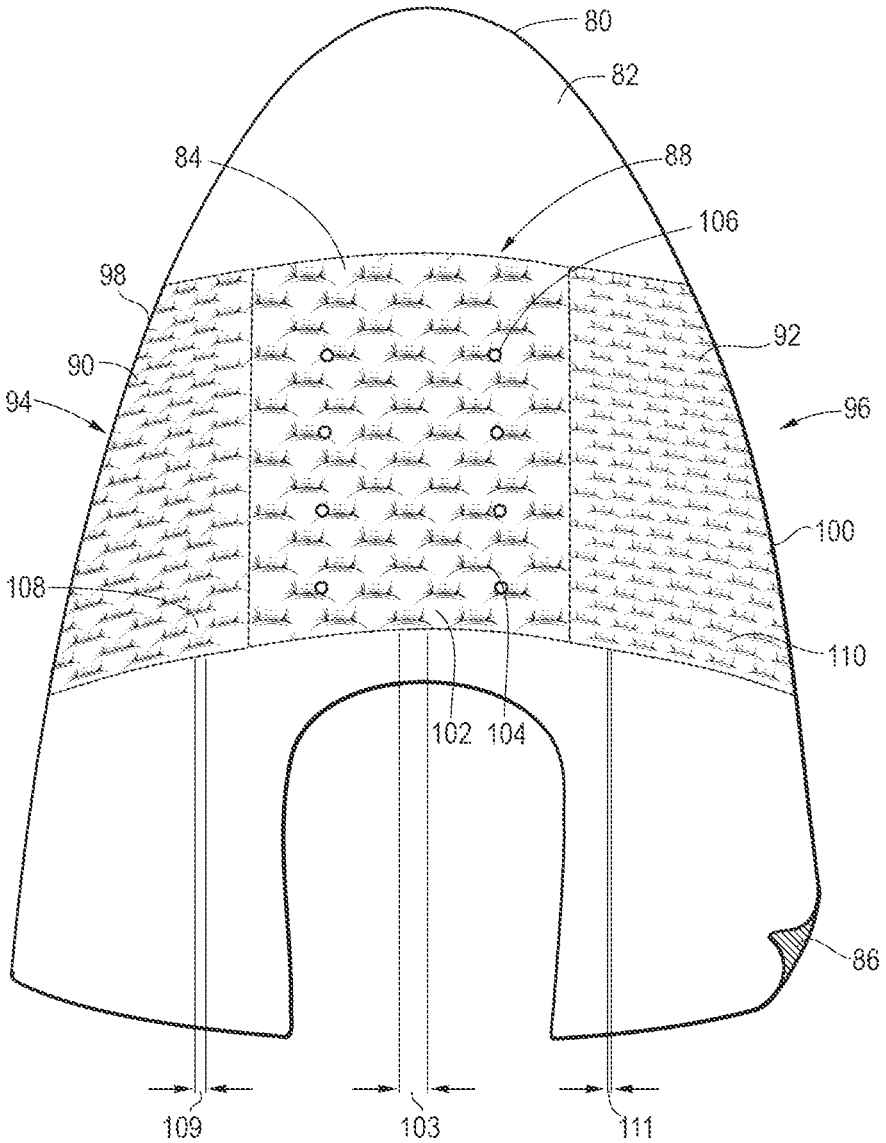
FIG. 4 shows a knitted upper including a knitted component including loft zones and loft portions, for example, as illustrated in FIGS. 1-2.

Referring now to FIG. 4, a knitted component 80 may be utilized in footwear applications, for example as part of an upper or an article of footwear. Knitted component 80 resembles a U-shape, however, it shall be understood that the "horseshoe"-shape or "U-shape" shape is merely exemplary, and other knitted components embodying the disclosure of this application may be knitted with edges in different locations, for example a "C-shaped" knitted component or a multiple-piece knitted component. Knitted component 80 includes a first layer 82 having an exterior surface 84 and a second layer 86. Knitted component 80 may further include one or more loft zones, for example a first loft zone 88 located on a vamp portion and extending continuously from a medial side 90 of knitted component 80 to a lateral side 92, a second loft zone 94 located on the medial side 90, and a third loft zone 96 located on the lateral side 92. Each of the first, second, and third loft zones 88, 94, 96 may have a different degree of loft constructed to provide a particular advantage or aesthetic. For example, the first loft zone 88 may have the highest degree of loft, the second loft zone 94 may have an intermediate loft level, and the third loft zone 96 may have the lowest degree of loft. To clarify, it is not necessary for loft zones to extend continuously across the knitted component (e.g., from a medial edge 98 to a lateral edge 100). Furthermore, each loft zone may have different knitting directions relative to one another. This may be accomplished through the use of knitted wedges or gores. Also, loft zones may exist in other areas of the knitted component, e.g., a forefoot region, midfoot region, or rearfoot region. Also, the location of one loft zone does not necessarily depend on the location of another loft zone, as the knit structures described above may be utilized in nearly any location of the knitted component. To clarify further, the knitted component 80 of FIG. 4 is one example, and other knitted components may include greater or fewer loft zones, and each loft zone may have different knit characteristics.

The first loft zone 88 may include one or more first loft portions 102, each having a first amount of loft (for example, characterized by a first dimension 103). Each first loft portion 102 may have a substantially course-wise orientation. The first loft zone 88 may include one or more recesses 104 that are depressed relative to the exterior surface 84 of the first layer 82, which may correspond with connection points between the first and second layers 82, 86 and may further define one or more loft portions 102. The first loft zone 88 may include one or more apertures 106 extending through one or both of the first and second layers 82, 86, which may eventually form part of a closure system of an article of footwear, for example. Apertures 106 may be sized to receive one or more of a lace, a tensile strand, a buckle, a strap or other component, and may extend through one or more of the loft portions 102. Additionally or alternatively, the first loft zone 88 may include an opening in a throat area (not shown in FIG. 4), for example to accommodate a tongue, which may be integral to the knitted component 80 or joined in a post-knitting step.

The second loft zone 94 may include one or more second loft portions 108 having a second amount of loft (for example, characterized by a second dimension 109), which may be more or less than the first amount of loft exhibited by the first loft portions 102. In the non-limiting embodiment of FIG. 4, the second amount of loft may be less than the first amount of loft. A lesser amount of loft may be advantageous in certain applications, e.g., if the knitted component 80 may eventually form part of an article of footwear for use in sports where the medial side 90 may be utilized to control a ball, e.g., soccer. However, in other applications, the second loft zone 94 may have greater or equal loft as compared with the first loft zone 88. Similarly, the third loft zone 96 may include one or more third loft portions 110 having a third amount of loft (for example, characterized by a third dimension 111), which may be greater than, lesser than, or equal to the first and second loft portions 102, 108. For example, greater loft in the third loft zone 96 may advantageously improve cushioning in athletic applications, e.g., basketball. However, FIG. 4 shows that third loft zone 96 may have less loft than either the first or second loft zones 88, 94.

Figure 5:
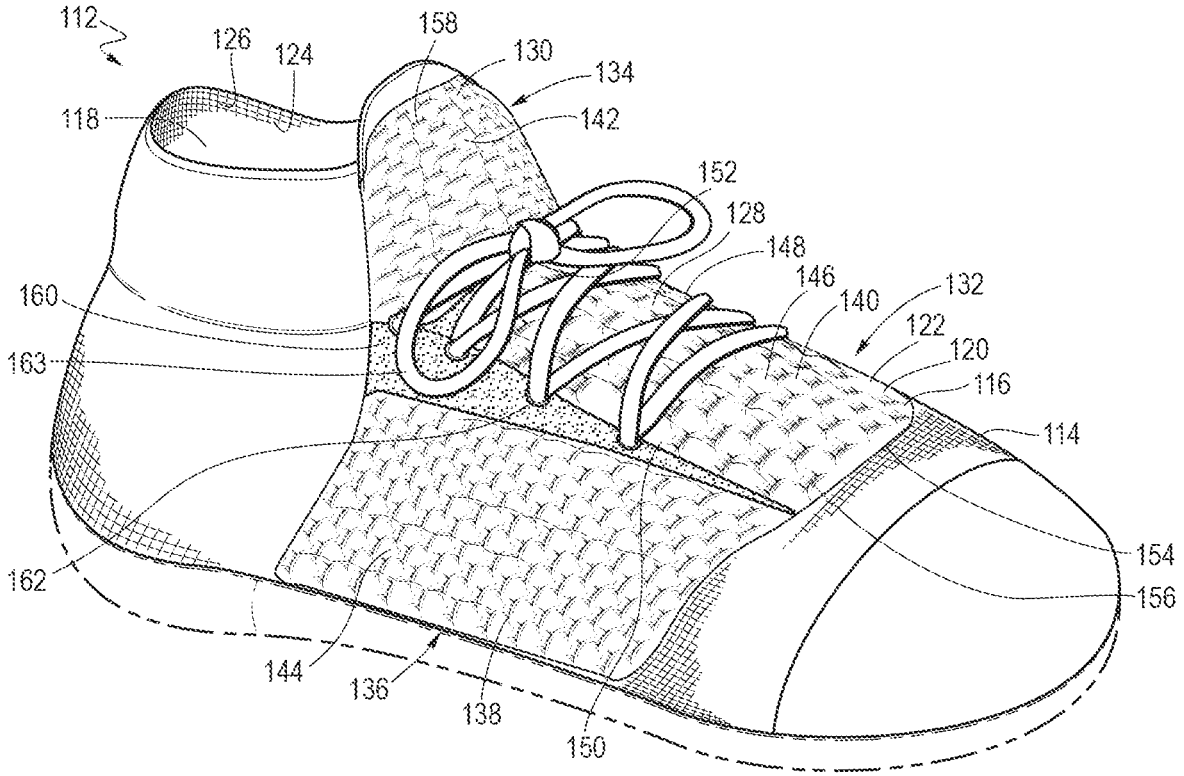
FIG. 5 shows an article of footwear including a knitted component including loft zones and loft portions, for example, as illustrated in FIGS. 1-2.

FIG. 5 illustrates an article of footwear 112 formed with an upper 114 substantially formed as a knitted component 116. Article 112 has a general configuration suitable for walking or running. Concepts associated with footwear, including the upper and knitted component, may also be applied to a variety of other athletic footwear types, including but not limited to baseball shoes, basketball shoes, cross-training shoes, cycling shoes, football shoes, soccer shoes, sprinting shoes, tennis shoes, and hiking boots. The concepts may also be applied to footwear types that are generally considered to be non-athletic, including dress shoes, loafers, sandals, and work boots. The concepts disclosed herein apply, therefore, to a wide variety of footwear types. Furthermore, the concepts disclosed herein may apply to articles beyond footwear, such as accessories or apparel. In the embodiment of FIG. 5, upper 114 may generally provide a comfortable and secure covering for a wearer's foot. As such, upper may define a void 118 to effectively receive and secure a foot within article. Moreover, an optional sole structure may be secured to a lower area of upper 114 and may extend between the foot and the ground to attenuate ground reaction forces (i.e., cushion the foot), provide traction, enhance stability, and influence the motions of the foot.

The article of FIG. 5 includes a first knit layer 120 having an exterior surface 122 that may be visible from the perspective of a viewer. The article further includes an interior second knit layer 124 adjacent the void 118, which is generally not visible from the perspective of a viewer. The second layer 124 may at least partially defined the void 118 and have an interior surface 126 that may face a wearer's foot in use. In one area of the article 112 (e.g., a throat area 128), the second layer 124 may be knitted with a first elasticized material. In another area of the article (e.g., a tongue area 130), the second layer 124 may be knitted with a second elasticized material having a different elasticity level. In other areas of article 112, the second layer 124 may include additional or alternative materials. Article 112 includes a first loft zone 132 located in the throat area 128, which is adjacent a second loft zone 134 located in the tongue area 130, and a third loft zone 136 located on a lateral midfoot area 138 of article 112. The first loft zone 132 includes a plurality of first loft portions 140 that extend away from the void 118, the second loft zone 134 includes a plurality of second loft portions 142 that extend away from the void 118, and the third loft zone 136 includes a plurality of third loft portions 144 that extend away from the void 118. Each of the first, second, and third loft zones 132, 134, 136 may include one or more courses of a material (not shown) selected for high bending resistance, and those courses of the third material may be knitted to include floats having one or more float lengths. In other embodiments, additional loft zones with similar or different locations and characteristics are possible.

The first loft zone 132 exhibits a first lofted appearance. The first loft portions 140 have an approximately course-wise orientation, except that transition portions 146 form wale-wise connections between adjacent first loft portions 140. The first loft portions 140 together project a chain-link or lattice-like appearance from the perspective of a viewer. The first loft zone 132 may extend continuously from a medial border 148 to a lateral border 150, the distance between which may vary. Likewise, the first loft zone 132 may extend continuously from a tongue border 152 to a forefoot border 154. The shape, dimension, and location of any of the aforementioned borders may differ in other embodiments. The first loft zone 132 has first depressions 156 formed relative to the exterior surface 122 of the first layer 120, at least one of the first depressions 156 having a first depth. The first depressions may correspond with connection points between the first and second layers 120, 124, such as a plurality of interlayer knit stitches. Each first loft portion 140 may be bounded by one of more of the first depressions 156 (e.g., bounded along course-wise borders), and may have a width corresponding to a distance between adjacent first depressions 156. Further, each first loft portion 140 may have a thickness corresponding to the distance from a point on the exterior surface 122 that extends furthest away from the void 118, to a nearest point on the interior surface 126 of the second layer 124. Together, these variables may characterize the first lofted appearance of the first loft portions 140 of the first loft zone 132.

Structurally, the first loft zone 132 may include a number of features that contribute to the first lofted appearance. For example, in the area of the first loft zone 132, the second layer 124 may include a first elasticized material having relatively high elasticity, e.g., a maximum elongation of at least approximately 150%. This property may contribute to a relatively large tensile force experienced by the second layer 124 in the area of the first loft zone 132, which causes the first loft portions 140 to form relatively pronounced bubble or convex shapes. Additionally or alternatively, each first loft portion 140 may include one or more courses of the material selected for relatively high bending resistance and having relatively large float lengths, e.g., at least five or six needles. The first loft zone 132 may include additional features that further characterize its appearance, including contrasting materials knitted into the first layer 120.

In the non-limiting embodiment of FIG. 5, the second loft zone 134 exhibits a second lofted appearance and substantially occupies the tongue area 130 of article 112. The second loft portions 142 have an approximately course-wise orientation and together project a cloud-like, quilt-like, or pillow-like appearance from the perspective of a viewer. The second loft zone 134 has second depressions 158 having a second depth that is less than the first depth (of first depressions 156 in the first loft zone 132), although this relationship may differ in other embodiments. Each second loft portion 142 may be bounded by one of more of the second depressions 158 (e.g., bounded along course-wise borders), and may have a width corresponding to a distance between adjacent second depressions 158. In the embodiment of FIG. 5, the width of the second loft portions 142 is greater than the width of the first loft portions 140. Further, each second loft portion 142 may have a thickness corresponding to the distance from a point on the exterior surface 122 that extends furthest away from the void 118, to a nearest point on the interior surface 126 of the second layer 124. In FIG. 5, the thickness of the second loft portions 142 is less than the thickness of the first loft portions 140. Together, these variables contribute to the second lofted appearance of the second loft zone 134. To clarify, the relationship between any of the foregoing variables of the second loft zone 134 may differ relative to variables of the first loft zone 132 in other embodiments.

Structurally, the second loft zone 134 may include a number of features that contribute to the second lofted appearance, and may further contribute to the "shooting up" appearance. In the area of the second loft zone 134, the second layer 124 may include a second elasticized material having lower elasticity than the first elasticized material, e.g., a maximum elongation of approximately 20%-50%. The relatively lower elasticity of the second elasticized material may contribute to a reduced tensile force experienced by the second layer 124 in the area of the second loft zone 134 as compared to the first loft zone 132. This reduced tensile force causes the second loft portions 142 to form a more subtle bubble or convex shape than the first loft portions 140. Additionally or alternatively, each second loft portion 142 may include one or more courses of the material selected for relatively high bending resistance, and having relatively shorter float lengths, e.g., approximately three or four needles. These features may potentially cause each second loft portion 142 to have a reduced thickness as compared to the first loft portions 140, or causing the second depressions 158 to have a shallower depth as compared to first depressions 156 in the first loft zone 140. Additionally or alternatively, each second loft portion 142 may include a larger number of courses of materials that make up the first and second layers 120, 124 between connection points, potentially contributing to greater width of each second loft portion 142 as compared to the first loft portions 140. Together, these variables may characterize the second lofted appearance of the second loft zone 134. Additionally, in the area of second loft zone 134, the article 112 may be substantially free of solid structure such as hard plastic or other rigid material, so that the knitted component can "shoot up" in the tongue area 130. Other structural features of knitted component 112 may accentuate this feature, including one or more knitted wedges or other features. For example, the knitted component 116 of article 112 may include at least one knitted triangular wedge 160 in between the first and second loft zones 132, 134. The triangular wedge 160 may include gradually shortening courses to achieve this shape. In the embodiment of FIG. 5, the triangular wedge 160 accentuates the "shooting up" appearance of the second loft zone 134 in the tongue area 130.

The third loft zone 136 exhibits a third lofted appearance, which in this case may be an intermediate lofted appearance that is more pronounced than the second loft zone 134, but less pronounced than the first loft zone 132. The third loft zone 136 may transition into the first loft zone 132 at the lateral border 150, which may have any number of regular or irregular shapes. Alternatively, the wedge 160 may separate the first and third loft zones 132, 136. The third loft portions 144 may be structurally similar to the first and/or second loft portions 140, 142, yet may vary in one or more ways to contribute to a different lofted appearance. For example, the area of the second layer 124 corresponding with the third loft zone 136 may be knitted with a different elasticized material and/or a different number of courses of the elasticized material. Additionally or alternatively, the third loft portions 144 may include greater or fewer courses of the material selected for relatively high bending resistance, which may have float lengths longer or shorter than in the first and second loft portions. Additionally or alternatively, in the area of the third loft zone 136, the first layer 120 may be knitted with materials selected to convey a different visual impression that one or both of the first or second loft zones 132, 134. Additionally, the third loft zone 136 may include a plurality of apertures 162 knitted into the first layer 120, which may form part of a closure system 163. The third loft zone 136 may include one or more yarns or strands (such as tensile strands) that are inlaid into the knitted component 116 between the first and second layers 120, 124, and which may protrude through the apertures 162. While shown as part of the third loft zone 136 in FIG. 5, the apertures 162 may additionally or alternatively form part of the first loft zone 132 or another loft zone in other embodiments.

Figure 6:
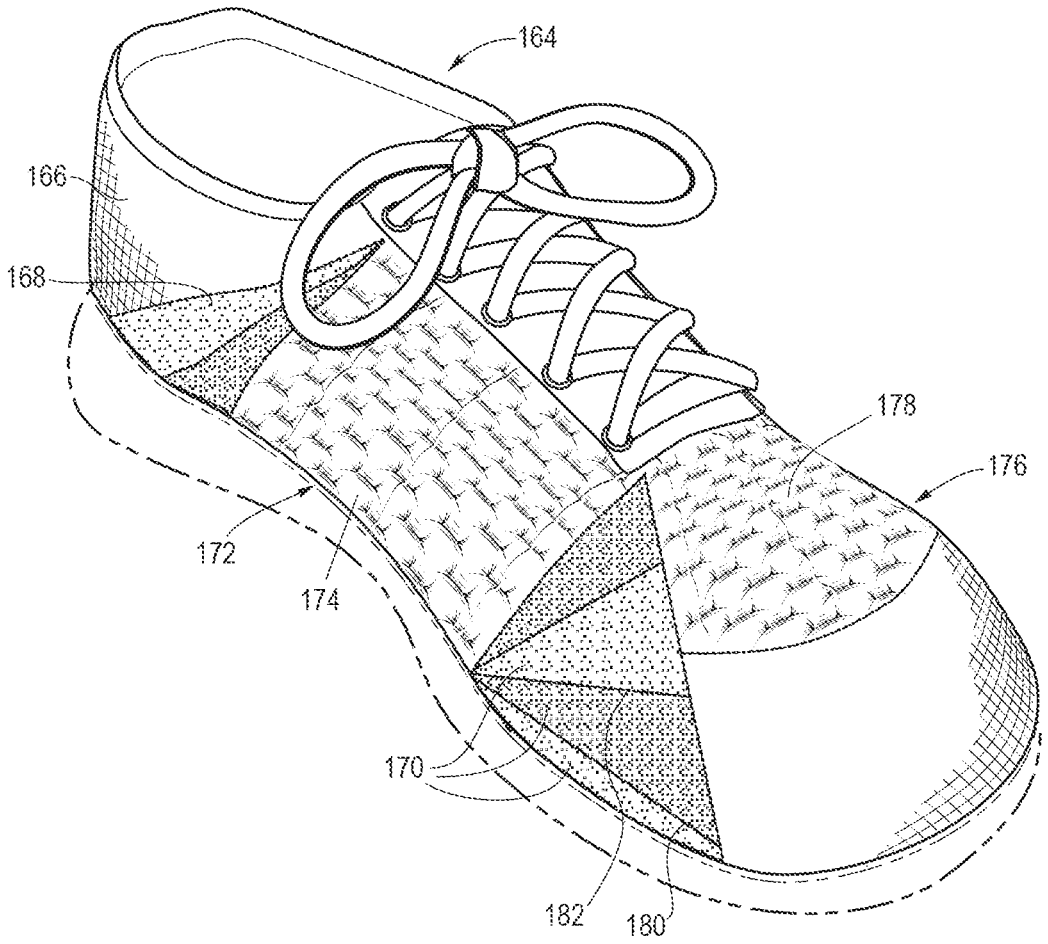
FIG. 6 shows another article of footwear including a knitted component including loft zones and loft portions, for example, as illustrated in FIGS. 1-2.

Referring now to FIG. 6, another article of footwear 164 includes an upper 166 primarily formed of a knitted component 168, which includes a number of wedges 170. The knitted component includes a first loft zone 172 in a midfoot region, including a plurality of first loft portions 174 having a longitudinal orientation (as compared to a lateral orientation, for example). Knitted component 168 also includes a second loft zone 176 located in a forefoot region of the knitted component 168, including a plurality of second loft portions 178 having a lateral orientation. The wedges 170 are knitted in between the first and second loft zones 172, 176 in order to facilitate changing the knitting direction. Each wedge 170 includes a base course 180 and a series of gradually shortening courses with a knitting direction approximately parallel to the base course 180. The gradually shortening courses, taken together, may form an angled edge 182 having a different orientation from the base course. A knitting machine may knit one or more courses along the angled edge 182 to change the knitting direction. By knitting one or more wedges 170 in between loft zones, it is possible to knit loft zones having different orientations.

While various embodiments of the features have been described, this disclosure is not to be restricted except in light of the attached claims and their equivalents. Moreover, the advantages described herein are not necessarily the only advantages and it is not necessarily expected that every embodiment will achieve all of the advantages described.

We claim:

1. A knitted component comprising:

a loft zone comprising a plurality of loft portions, each loft portion comprising:

a first knitted layer;

a second knitted layer comprising an elasticated first material, the first knitted layer comprising a second material having a lower elasticity than the elasticated first material;

a void between the first knitted layer and the second knitted layer; and at least one course of the second material that is knitted within the void, the at least one course projecting into the void to cause the first knitted layer to extend away from the second knitted layer by a distance of about 2-5 mm;

wherein each loft portion has a width of about 4-10 mm defined between a first connection point between the first knitted layer and the second knitted layer and a second connection point between the first knitted layer and the second knitted layer; and wherein a recess having a depth of about 2-5 mm extends between adjacent loft portions.

2. The knitted component of claim 1, wherein the at least one course of the second material recoils away from the first knitted layer and the second knitted layer.

3. The knitted component of claim 1, wherein the second material is a monofilament strand having a diameter of approximately 0.05 to approximately 0.3 mm.

4. The knitted component of claim 1, wherein the at least one course of the second material comprises at least one float having a float length of at least three needles.

5. The knitted component of claim 1, wherein each loft portions has an elongate shape that extends in a course-wise direction.

6. The knitted component of claim 1, wherein each loft portions has an approximately wale-wise orientation.

7. The knitted component of claim 1, wherein the second knitted layer consists essentially of the elasticated first material.

8. The knitted component of claim 1, wherein the elasticated first material comprises elastane fibers.

9. The knitted component of claim 1, wherein the elasticated first material comprises a yarn having a core that is surrounded by a sheath.

10. The knitted component of claim 1, wherein the elasticated first material has a maximum elongation greater than 180%.

11. A knitted component comprising:

a loft zone having a first knitted layer, a second knitted layer comprising an elasticated first material, the first knitted layer comprising a second material having a lower elasticity than the elasticated first material, and a plurality of loft portions;

wherein each loft portion comprises a portion of the first knitted layer, a portion of the second knitted layer, a void formed between freely separable areas of the first knitted layer and the second knitted layer, and at least one course of the second material knitted within the void;

wherein the at least one course of the second material recoils away from the first knitted layer and the second knitted layer to cause the first knitted layer to extend away from the second knitted layer by a distance of about 2-5 mm;

wherein each loft portion has a width of about 4-10 mm defined between a first connection point between the first knitted layer and the second knitted layer and a second connection point between the first knitted layer and the second knitted layer; and wherein an area of the first knitted layer between the first connection point and the second connection point forms a convex shape.

12. The knitted component of claim 11, wherein the void is formed in a course-wise direction.

13. The knitted component of claim 11, wherein the void is formed in a wale-wise direction.

14. The knitted component of claim 11, wherein the second knitted layer has stretch in both a course-wise direction and a wale-wise direction.

15. The knitted component of claim 11, wherein the convex shape has a bubble shape.

* * * * *